United States Patent [19]

Kyle

[11] 4,143,380

[45] Mar. 6, 1979

[54] COMPACT SPIRAL ANTENNA ARRAY

[75] Inventor: Robert H. Kyle, Portola Valley, Calif.

[73] Assignee: EM Systems, Inc., Sunnyvale, Calif.

[21] Appl. No.: 791,580

[22] Filed: Apr. 27, 1977

[51] Int. Cl.[2] ..... H01Q 3/26; H01Q 1/36

[52] U.S. Cl. ..... 343/895; 343/854

[58] Field of Search ..... 343/854, 895

[56] References Cited

U.S. PATENT DOCUMENTS

| | | | |
|---|---|---|---|
| 3,594,802 | 7/1971 | Koob | 343/895 |
| 3,940,772 | 2/1976 | Ben-Dov | 343/895 |
| 4,012,744 | 3/1977 | Greiser | 343/895 |

*Primary Examiner*—Craig E. Church
*Assistant Examiner*—Harry E. Barlow
*Attorney, Agent, or Firm*—Thomas Schneck, Jr.

[57] ABSTRACT

An array of spiral antennas formed conformally about a cylindrical surface. The antennas share a common cavity or resonance chamber of annular cross section inside the cylinder.

13 Claims, 5 Drawing Figures

COMPACT SPIRAL ANTENNA ARRAY

BACKGROUND

1. Field of the Invention

This invention relates generally to spiral antenna systems and more specifically to an array of spiral antennas compactly mounted with improved directional pattern characteristics.

2. Prior Art

Spiral antennas existing in the prior art consist essentially of a spiral of conductor formed or otherwise attached to a flat surface. The spirals themselves come in many patterns and shapes from the Archimedian and equiangular spirals to the sawtoothed vanishing square.

Regardless of the pattern of the spiral, a spiral antenna with no reflecting surface placed in its radiation pattern will radiate a broad beam in two directions perpendicular to its face. Likewise, reception of radiation energy would be from both directions perpendicular to its face. Consequently, a spiral antenna is often provided with a cavity on one side to increase directional sensitivity. An example of a spiral antenna with a cavity is U.S. Pat. No. 3,192,531.

An array of spiral antennas each with its reflector and resonance cavity has been used for direction finding purposes or for the purpose of achieving desired directional patterns. The antennas are spaced about points of the compass for discrimination of angle of arrival by the relative signal level received on each spiral.

A problem inadequately addressed in the prior art is how to make such an array of spiral antennas compact. An array of discrete spiral antennas does not, in conventional systems, put to effective use the space it occupies. Prior approaches also resulted in differences between directional patterns of individual antennas causing direction finding errors.

It is an object of this invention to make a compact spiral antenna array with more uniform directional pattern performance.

SUMMARY

The above object has been satisfied by providing a cylindrical antenna array in which a greater cylinder supports a plurality of antenna elements. These elements can be etched directly on the cylinder. The greater cylinder coaxially surrounds a lesser cylinder. A cavity is defined between the walls of the two cylinders which is filled with various types of radiation absorbing material in order to allow operation over wide frequency ranges. Upper and lower covers are often provided for the top and bottom of the two cylinders.

The lesser cylinder acts as a common reflector for all of the antenna elements supported by the radiation transparent greater cylinder. The cavity is likewise shared as a resonance chamber. This unique feature of shared cavity and reflector allows a marked reduction in antenna package size, as well as introducing certain electrical advantages due to the lack of sidewall reflection which might occur in a box-shaped cavity.

A further reduction in antenna package size was achieved by creating an antenna feed which had its balanced and unbalanced energy throughputs at mutual right angles. The feed utilizes a balun and a balun extender including a short piece of balanced feedline attached at right angles to the balun extender.

A further advantage to the cylindrical design and right angle antenna feed is that the axial hole defined in the center of the lesser cylinder may be left unobstructed for the passing cables from equipment mounted above or below. Cables, waveguides or optics used in periscopes can be passed through without interfering with antenna performance. The outer cylinder may be enclosed in a radome.

The present antenna system may be used for either transmission or reception when connected to either a receiver or transmitter. The antenna system of the present invention provides more uniform directional pattern performance and more repeatable patterns from system to system.

DESCRIPTION OF THE PREFERRED EMBODIMENT

Figure 1:
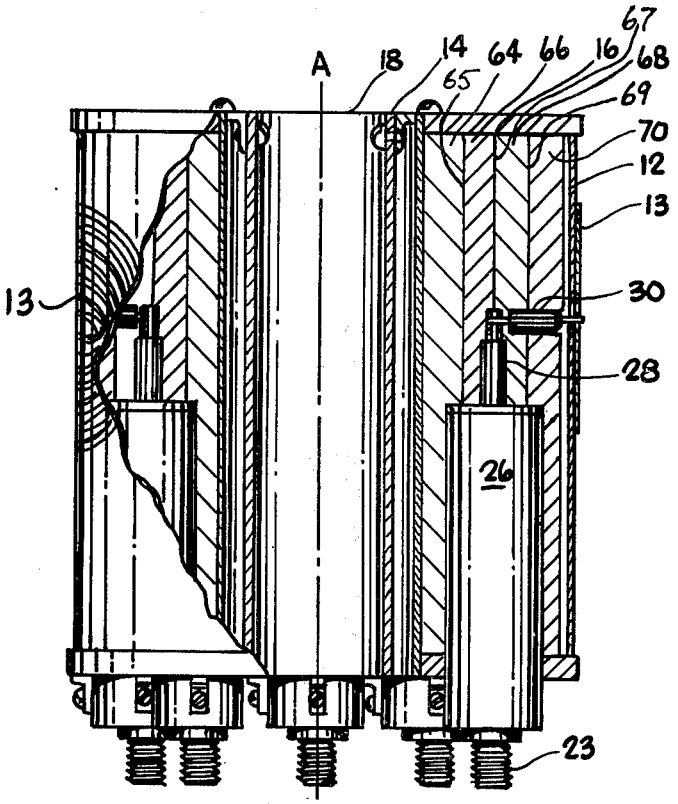
FIG. 1 is a cutaway frontal view of the antenna array of the present invention.

FIG. 1 shows the conformal antenna array of the present invention with a greater cylinder 12 and a lesser cylinder 14. Greater cylinder 12 coaxially surrounds lesser cylinder 14 at a common axis A. Both cylinders are of the same height, and their top and bottom lateral ends are aligned in the same plane, respectively.

Greater cylinder 12 is made of a material which is transparent to radiated electromagnetic energy. The present invention uses a 0.020 inch thick piece of Duroid, a dielectric, but any suitable support material transparent to radiated energy may be used.

Attached to greater cylinder 12 are spiral antenna elements 13. The present embodiment utilizes six of them, although this number is not critical. Spiral antenna elements 13 are of a conventional pattern consisting of a twin interleaving of spiraling conductors. Spiral antenna elements 13 are etched on, and thereby conform to, the surface of greater cylinder 12. The antennas are preferably positioned about the circumference of the greater cylinder at equal angles about the cylinder axis to achieve omnidirectional coverage, but may be positioned in any other pattern necessary to achieve desired coverage.

Antenna elements 13 may be positioned on greater cylinder 12 by other methods than etching. For instance, antenna elements 13 may be deposited onto the surface of greater cylinder 12. Alternatively, antenna elements 13 may comprise wires mounted upon or embedded within the surface of greater cylinder 12. Antenna elements 13 may be made as a discrete unit and then be adhesively or otherwise fastened to the surface of greater cylinder 12. For low frequency antennas they may even form their own support, thereby actually replacing the dielectric surface of the outer cylinder.

Lesser cylinder 14 acts as a common reflector for antenna elements 13. Lesser cylinder 14 may be made of any suitable material which reflects incident electromagnetic energy including aluminum or copper. It may also be made of any material which is coated or treated to make it reflect incident electromagnetic energy.

Cavity 16 is defined as the space between greater cylinder 12 and lesser cylinder 14. Cavity 16 acts as a common resonance chamber for antenna elements 13. by resonance chamber is meant that radiation radiated rearwardly from antennas on the greater cylinder 12 will travel toward the lesser cylinder 13, be reflected from some point in between and arrive in phase with radiation transmitted forwardly or outwardly from the antennas. Due to the cylindrical design of our present invention there are no sidewalls present in the resonance cavity. This fact leads to certain advantages in electrical performance. It may be seen that microwave absorbers 64, 66, 68, 70 are positioned within cavity 16. Microwave absorbers are often foam, loaded with carbon or other attenuating materials. One such absorber is known under the trademark Eccosorb. In the present embodiment microwave absorbers 64, 66, 68 are approximately ⅛ inch thick sheets of Eccosorb and microwave absorber 70 is a ⅜ inch thick sheet of Eccosorb. These microwave absorbers should attenuate interfering radiation from neighboring antenna elements while permitting reflection and in phase reinforcement to the same antenna. The optimum width for cavity 16 is one quarter wavelength. However, over a typical operating frequency range of 2 to 18 gigahertz, this distance will vary from a fraction of an inch to over an inch. The width of cavity 16 is selected to correspond to one quarter wavelength at the lowest operating frequency. All microwave absorbers are somewhat reflective, moreso at higher frequencies. Absorber planes 65, 67, 69 are positioned so that higher frequency radiation is reflected from a point approximately one quarter wavelength from the spiral circuit. The carbon concentration in the different layers of absorber is also varied to control the frequency dependence of the reflections.

Axial hole 18 is defined by the volume of space surrounded by lesser cylinder 14. Axial hole 18 is unobstructed and may be used to pass masts, cables, waveguides or other objects therethrough. Since the mast or other object is out of the radiation patterns of the antenna elements, it cannot interfere with the array's transmission and reception. Transmission, power and other lines may also be passed through axial hole 18 without impairment of the array's performance.

Figure 2:
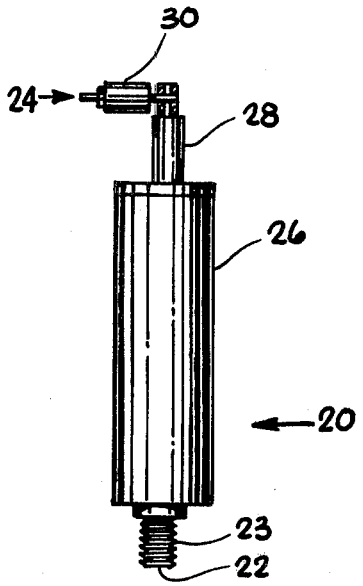
FIG. 2 is a side detail view of the right angle antenna feed.

Referring now to FIG. 2 a detail of antenna feed 20 may be seen. Antenna loader 20 has an unbalanced energy throughput 22 and a balanced energy throughput 24. The unbalanced energy throughput 22 in the present invention connects to a coaxial connector 23.

Coaxial connector 23 is connected to balun 26 which is in turn connected to balun extender 28. A segment of balanced transmission line, shielded twin lead 30, is positioned at right angles, and then attached to, balun extender 28.

Referring momentarily to FIG. 1, it may be seen that balun 26, extender 28 twin lead segment 30 are positioned within cavity 16 for each antenna element 13. The terminal end of twin lead 30 of each antenna feed 20 is connected to its respective antenna element 13. Balun 26 has an elongated dimension, i.e., a length, which extends downwardly past the bottom of cylinders 12 and 14. Most of the balun, especially the balun extender is surrounded by radiation absorbing material. It may be seen how the right angle relationship between unbalanced energy throughput 22 and balanced energy throughput 24 of antenna loader 20 reduces overall package size.

Figure 3:
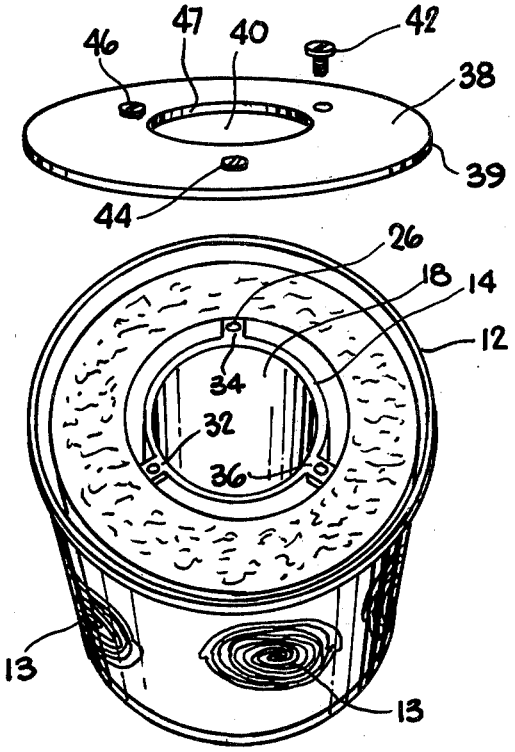
FIG. 3 is an exploded perspective view of the top of the apparatus of FIG. 1.

Referring now to FIG. 3, it may be seen that in the present embodiment lesser cylinder 14 is provided with L brackets 32, 34, 36 at its top ends. They may be attached in a variety of ways including machine screws, bolts or by soldering or welding. An upper cover 38 provided with a circular groove 39 of the same circumference as greater cylinder 12 is positioned so that the top of greater cylinder 12 fits in groove 39. Upper cover 38 is provided with a hole 40 of the same circumference as lesser cylinder 14 to allow unhindered acess to axial hole 18. Machine screws 42, 44, 46 fit correspondingly holes of upper cover 38. Machine screws 42, 44, 46 engage with L brackets 32, 34, 36 to securely fasten upper cover 38 to the top of lesser cylinder 14 and greater cylinder 12. Cover 38 may have hole 40 omitted and thereby be solid in construction if, for instance, it is desirable to have a mast passing through axial hole 18 to terminate at upper cover 38.

Figure 4:
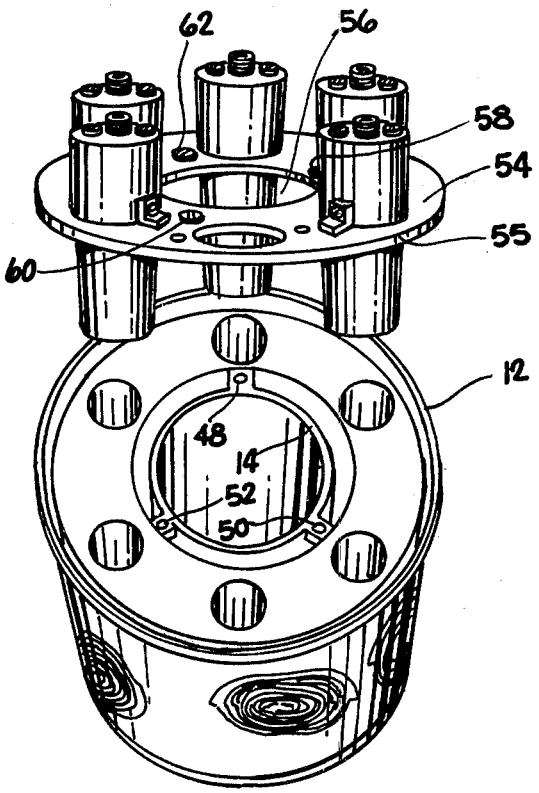
FIG. 4 is an exploded perspective view of the bottom of the apparatus of FIG. 1.

Referring now to FIG. 4 it may be seen that the lesser cylinder 14 is provided with L brackets 48, 50, 52 at its bottom end. They may be attached in any of the ways described for L brackets 32, 34, 36. A lower cover 54 provided with a circular groove 55 of the same circumference as greater cylinder 12 is positioned so the bottom of greater cylinder 12 fits in groove 55. Lower cover 54 is provided with a hole 56 of the same circumference as that of lesser cylinder 14 to allow unhindered access to axial hole 18. Machine screws 58, 60, 62 fit into corresponding holes of lower cover 54. Machine screws 58, 60, 62 engage L brackets 48, 50, 52 to securely fasten lower cover 54 to the bottom of lesser cylinder 14 and greater cylinder 12. Lower cover 54 is also provided with holes for the passage of the portion of the baluns which project beyond the greater and lesser cylinder's bottom end. The balun ends are secured to lower cover 54 with a plurality of L brackets and machine screws.

Upper cover 38 and lower cover 54 may be made of material which reflects electromagnetic energy. However, the covers 38 and 54 are spaced from the antenna elements sufficiently that there is little or no sidewall reflection from the covers. The covers 38 and 54 may also be made of radiation transparent material, such as plastic.

Figure 5:
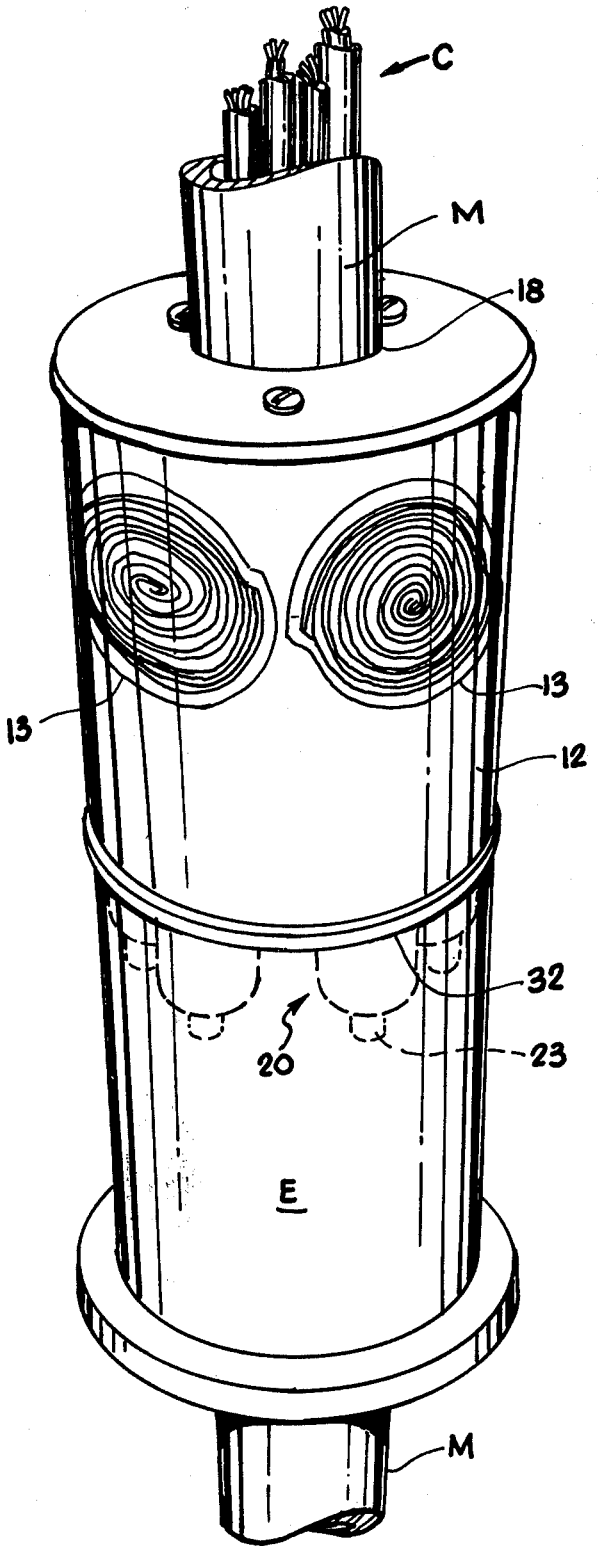
FIG. 5 is a perspective view of the present invention in a typical installation.

A fully assembled conformal antenna array system is depicted in FIG. 5. A mast M is shown passing through axial hole 18. Having unbalanced energy throughput 23 emerge through lower-cover 32 allows receiver package E to attach directly to antenna feed 20. This feature minimizes transmission lineloss.

The compact geometry of the spiral antenna array of the present invention is especially suited for direction finding and similar applications where directional finding capability is required without moving the antenna, and space for the antenna is at a minimum. By connecting each antenna element to a separate receiver, direction finding can be achieved with the antennas seeing all directions simultaneously. The antenna can also be used in applications where the improved antenna patterns achieved with this technique are required for more precise direction finding.

What is claimed is:

1. A conformal antenna system comprising, (a) a greater cylinder having an axis, said greater cylinder being transparent to electromagnetic radiation, (b) a lesser cylinder having an axis, said lesser cylinder being reflective of electromagnetic radiation, said lesser cylinder being of lesser circumference than said greater cylinder and being coaxially positioned within said greater cylinder, said lesser and greater cylinders defining a cavity therebetween, (c) a plurality of spiral antenna elements conformally positioned on said greater cylinder such that said antenna elements are circumferentially spaced about said axis of said greater cylnnder whereby the cavity and said lesser cylinder are shared by said antenna elements.

2. A conformal antenna system as described in claim 1 further comprising electromagnetic radiation absorbing material cylindrically disposed in said cavity.

3. A conformal antenna system as described in claim 1 in which the volume surrounded within said lesser cylinder defines an axial passageway whereby objects may be passed therethrough.

4. A conformal antenna system as described in claim 1 wherein said antenna elements are spiral antennas disposed about said greater cylinder at equal angles from the axis of said cylinder.

5. A conformal antenna system as described in claim 1 further comprising upper and lower circular covers, said circular covers having a circumference at least the size as a circumference of said greater cylinder, said upper circular cover being positioned in alignment with a top of said greater cylinder, said lower circular cover being positioned in alignment to a bottom of said greater cylinder.

6. A conformal antenna system as described in claim 5 where said circular covers each define a central circular hole of the same circumference as said lesser cylinder.

7. A conformal antenna system as described in claim 1 further comprising feed means for connecting said antenna elements to a source or detector of electromagnetic radiation.

8. A conformal antenna system as described in claim 7 wherein said feed means comprises a plurality of baluns equal in number to said plurality of spiral antenna elements, each balun having an unbalanced transmission line connection terminated in a coaxial transmission line connector and a balanced transmission line connection connected to a respective one of said plurality of spiral antenna elements.

9. A conformal antenna system as described in claim 8 wherein each of said baluns has an elongated dimension which is disposed between said greater and lesser cylinders.

10. The system of claim 9 wherein the elongated dimension of each balun is parallel to the axis of said greater cylinder.

11. The conformal antenna system of claim 10 wherein each coaxial connector of said baluns is mounted between said greater and lesser cylinders and extends axially outwardly from said cylinders.

12. A conformal antenna system comprising, (a) a greater cylinder having an axis, said greater cylinder being transparent to electromagnetic radiation, (b) a lesser cylinder having an axis, said lesser cylinder being reflective of electromagnetic radiation, said lesser cylinder being of lesser circumference than said greater cylinder and being coaxially positioned within said greater cylinder, said lesser and greater cylinders defining a cavity therebetween, (c) a plurality of spiral antenna elements conformally positioned on said greater cylinder such that said antenna elements are circumferentially spaced about said axis of said greater cylinder whereby the cavity and said reflective lesser cylinder are shared by said antenna elements (d) a plurality of baluns, equal in number to said plurality of spiral antenna elements, each balun having a balanced transmission line terminal being connected to a spiral antenna element and an unbalanced transmission line terminal being terminated in a coaxial transmission line connector, each balun having an elongated dimension disposed between greater and lesser cylinders and extending outwardly therebetween.

13. The system of claim 12 wherein said spiral antennas are disposed on said greater cylinder at equal angles about the axis of said cylinder.

* * * * *